US008323132B2

(12) United States Patent
Kirsch

(10) Patent No.: US 8,323,132 B2
(45) Date of Patent: Dec. 4, 2012

(54) DETACHABLE APPARATUS FOR SECURING A TRANSMITTING DEVICE FOR USE WITH A HUNTING ARROW FOR TRACKING GAME

(76) Inventor: Phillip Kirsch, Racine, WI (US)

( * ) Notice: Subject to any disclaimer, the term of this patent is extended or adjusted under 35 U.S.C. 154(b) by 0 days.

(21) Appl. No.: 12/983,008

(22) Filed: Dec. 31, 2010

(65) Prior Publication Data

US 2012/0172158 A1 Jul. 5, 2012

(51) Int. Cl.
*F42B 6/04* (2006.01)

(52) U.S. Cl. ..... 473/578

(58) Field of Classification Search ..... 473/578, 473/582, 583, 585, 586
See application file for complete search history.

(56) References Cited

U.S. PATENT DOCUMENTS

| | | | | |
|---|---|---|---|---|
| 2,989,310 | A | 6/1961 | Lamond | |
| 3,790,948 | A | 2/1974 | Ratkovich | |
| 4,166,619 | A | 9/1979 | Bergmann et al. | |
| 4,675,683 | A | 6/1987 | Robinson et al. | |
| 4,836,557 | A | 6/1989 | Polando | |
| 4,858,935 | A | 8/1989 | Capson | |
| 4,885,800 | A | 12/1989 | Ragle | |
| 4,905,397 | A | 3/1990 | Juelg, Jr. | |
| 4,940,245 | A | 7/1990 | Bittle, Jr. | |
| 4,951,952 | A * | 8/1990 | Saddler | 473/570 |
| RE33,470 | E | 12/1990 | Boy et al. | |
| 4,976,442 | A | 12/1990 | Treadway | |
| 5,022,658 | A | 6/1991 | Burkhart | |
| 5,143,380 | A | 9/1992 | Maleski | |
| 5,188,373 | A | 2/1993 | Ferguson et al. | |
| 5,446,467 | A | 8/1995 | Willett | |
| 5,450,614 | A | 9/1995 | Rodriquez | |
| 5,496,041 | A | 3/1996 | Broussard | |
| 6,612,947 | B2 * | 9/2003 | Porter | 473/578 |
| 6,764,420 | B2 | 7/2004 | Cyr et al. | |
| 6,814,678 | B2 | 11/2004 | Cyr et al. | |
| 6,856,250 | B2 | 2/2005 | Hilliard | |
| 7,232,389 | B2 | 6/2007 | Monteleone | |
| 7,300,367 | B1 | 11/2007 | Andol et al. | |
| D556,612 | S | 12/2007 | Beecher et al. | |
| 7,632,199 | B2 | 12/2009 | Kikos | |
| 7,909,714 | B2 * | 3/2011 | Cyr et al. | 473/578 |
| 2003/0132846 | A1 | 7/2003 | Hilliard | |
| 2003/0176245 | A1 | 9/2003 | Cyr et al. | |
| 2010/0248871 | A1 * | 9/2010 | Nick et al. | 473/570 |

* cited by examiner

*Primary Examiner* — John Ricci
(74) *Attorney, Agent, or Firm* — K&L Gates LLP

(57) ABSTRACT

A tracking apparatus for securing a transmitting device onto a target game animal. The tracking apparatus engages with a target and separates the apparatus from the arrow. The apparatus includes a transmitting device for transmitting a signal to a receiving device; a stopping component for detaching the tracking apparatus from the arrow after the arrow collides with the target; and a securing component for securing the tracking apparatus to the target, said securing component including barbs angled towards the rear of the arrow for stopping rebound motion of the tracking apparatus after the arrow collides with the target. In one embodiment, the barbs are reinforced with reinforcing arms. In another embodiment, the securing component includes a torsion spring. In another embodiment, the stopping component includes one or more wings with a front edge facing the front of the arrow that is relatively perpendicular to the axis of the arrow.

18 Claims, 10 Drawing Sheets

DETACHABLE APPARATUS FOR SECURING A TRANSMITTING DEVICE FOR USE WITH A HUNTING ARROW FOR TRACKING GAME

TECHNICAL FIELD

The present application relates in general to a hunting apparatus for hunting game and more specifically to a detachable apparatus with a transmitting device for use with a bow hunting arrow.

BACKGROUND

Arrow-mounted game tracking devices that include an electronic transmitting device are known in the hunting industry. During the pursuit of a game animal the archer will launch the arrow along with the attached transmitting device into the target animal. These devices typically require equipping an arrow with an electronic transmitting device, either with a permanently attached transmitting device or with a detachable transmitting device that uses hooks to try and attach the transmitting device to the wounded animal. These devices are intended to operate such that once an arrow is embedded in a game animal, the hunter may use a hand-held receiver to locate the position of the wounded game. However, modern bows used for hunting bear, elk, caribou, deer, turkey, and other game animals are powerful enough to shoot an arrow, and thus the electronic transmitting device, completely through the animal at even long ranges. Existing devices that utilize detachable components to attempt to embed the transmitting device in the game animal using hooks or other mechanisms suffer from numerous deficiencies, including requiring custom made arrows, negatively effecting the flight of the arrow, failing to secure the transmitting device in the game animal upon impact, or allowing the transmitting device to fall out before the hunter is able to track the wounded animal.

The rebound, or deflection, energy of a solid mass in motion coming in contact with a relatively solid wall (e.g., the target game animal) is great, and as a result existing detachable devices with transmitting devices continue in motion by rebounding in a direction relative to its point of origin, similar to the result of throwing a rubber ball against a wall. Modem arrows can launch and impact at speeds of 250 to 450 feet per second, and upon impact that mass in motion contains extreme energy to rebound. Thus, in such cases, the detachable device may rebound back off and/or out of the animal. Or, if the detachable transmitting device does not rebound off the animal and does attach, it may still be pulled out before the hunter is able to locate the animal due to the animal rubbing against obstacles like trees, bushes, ground, and rocks, or the animal instinctively pulling the attached transmitting device out.

It is thus an object of the present invention to provide a new and improved detachable apparatus that includes a transmitting device which is designed to securely attach the transmitting device to a game animal upon impact when the arrow passes through the animal.

SUMMARY

In one embodiment, the present disclosure is directed to a tracking apparatus for detaching and securing a transmitting device carried by an arrow having a front end and rear end onto a target, said tracking apparatus comprising: a transmitting device for transmitting a signal to a receiving device; a stopping component for detaching the tracking apparatus from the arrow after the arrow collides with the target; and a securing component for securing the tracking apparatus to the target, said securing component including barbs angled towards the rear end of the arrow for stopping rebound motion of the tracking apparatus after the arrow collides with the target.

In another embodiment, the present disclosure is directed to a detachable nock for detaching and securing a transmitting device carried by an arrow having a front end and rear end onto a target, said detachable nock comprises: an opening for receiving a bowstring situated at the rear of the detachable nock; a transmitting device for transmitting a signal to a receiving device; a stopping component for detaching the detachable nock from the arrow after the arrow collides with the target, wherein the stopping component includes one or more wings with a front edge facing the front end of the arrow that is relatively perpendicular to the axis of the arrow; and a securing component for securing the detachable nock to the target, said securing component including barbs angled towards the rear end of the arrow for stopping rebound motion of the detachable nock after the arrow collides with the target.

In yet another embodiment, the present disclosure is directed to a tracking apparatus for detaching and securing a transmitting device carried by an arrow having a front end and rear end onto a target, said tracking apparatus comprising: a transmitting device for transmitting a signal to a receiving device; a stopping component for detaching the tracking apparatus from the arrow after the arrow collides with the target; and an anchor component for stopping forward motion of the tracking apparatus after the arrow collides with the target, said anchor component including forward barbs angled towards the front end of the arrow; and a securing component for securing the tracking apparatus to the target, said securing component including reverse barbs angled towards the rear end of the arrow for stopping rebound motion of the tracking apparatus after the arrow collides with the target.

DETAILED DESCRIPTION

Figure 1:
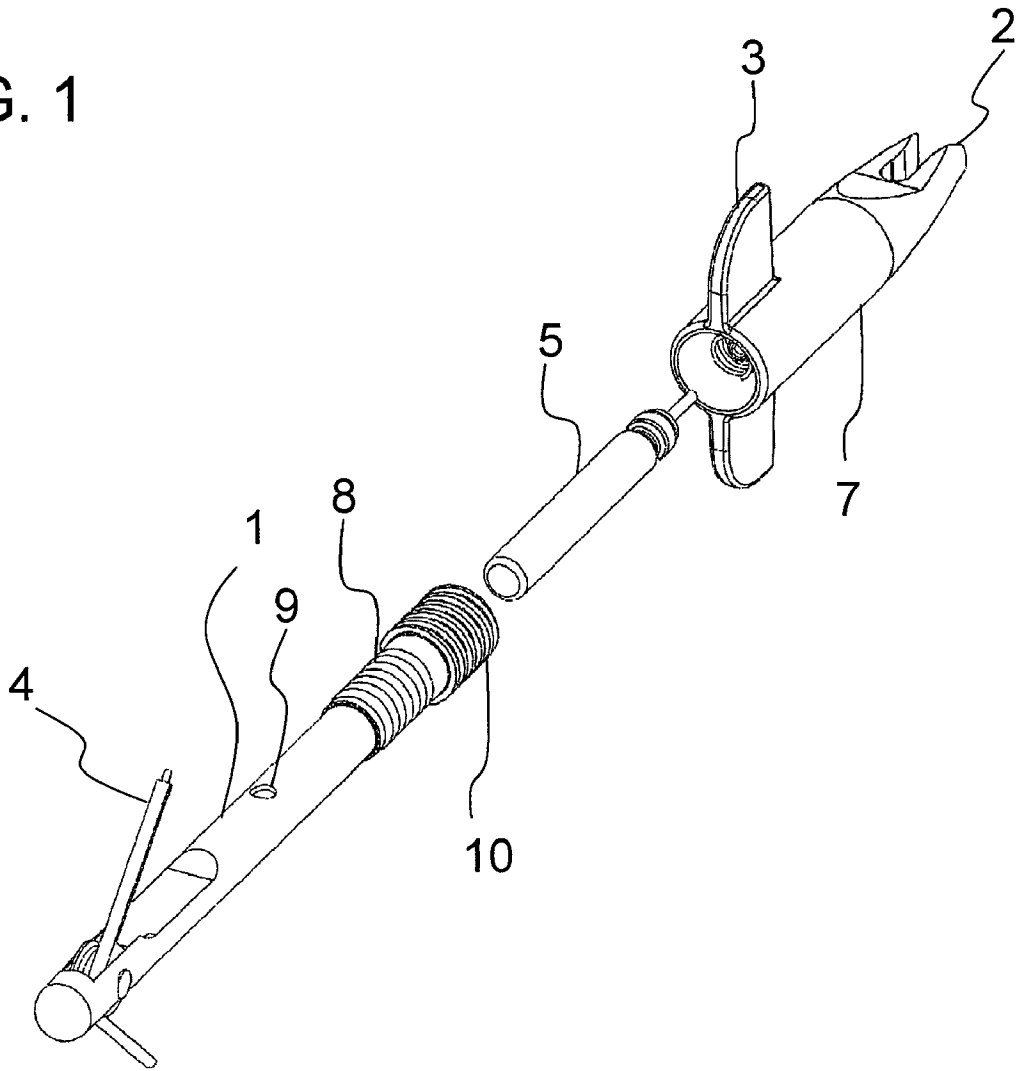
FIG. 1 is an exploded perspective view of an embodiment of a detachable tracking apparatus.

The present disclosure provides an apparatus for hunting game and more specifically to a detachable tracking apparatus with a transmitting device for use with a bow hunting arrow. In one embodiment, the tracking apparatus is part of an arrow nock assembly. In other embodiments, the detachable tracking apparatus can be a separate component or components from the arrow nock to allow the hunter to use their preferred arrow nocks.

As depicted in FIGS. 1 to 5, in one embodiment, the detachable tracking apparatus includes a front section 1 that includes a securing component 4 attached to the apparatus for securing the tracking apparatus to the target, a stopping component 3 affixed to the apparatus for detaching the tracking apparatus from the arrow after the arrow collides with the target, a nock 2 to attach to the bow string, and a transmitting device that includes a battery 5 and PCB 6. The front section 1 may be made out of aluminum, carbon, acrylic polymer or plastic or other suitable durable materials that have a high tensile strength to weight ratio.

In one embodiment, the tracking apparatus snugly fits inside the rear end of the shaft of an arrow using an interference fit (e.g., a friction or compression fit) between a ridged portion 8 of the front section 1 to keep the tracking apparatus attached to the arrow shaft during the period the archer draws the string back and the arrow is dragging on the arrow rest. In another embodiment, the tracking apparatus include pressure bumps to make contact with the arrow shaft. In yet another embodiment, the entire front section 1 forms an interference fit to the arrow shaft. One of skill in the art would appreciate that any method of detachably securing the tracking apparatus to the arrow shaft such that the tracking apparatus will detach from the arrow shaft upon target collision is within the scope of this disclosure.

Figure 8:
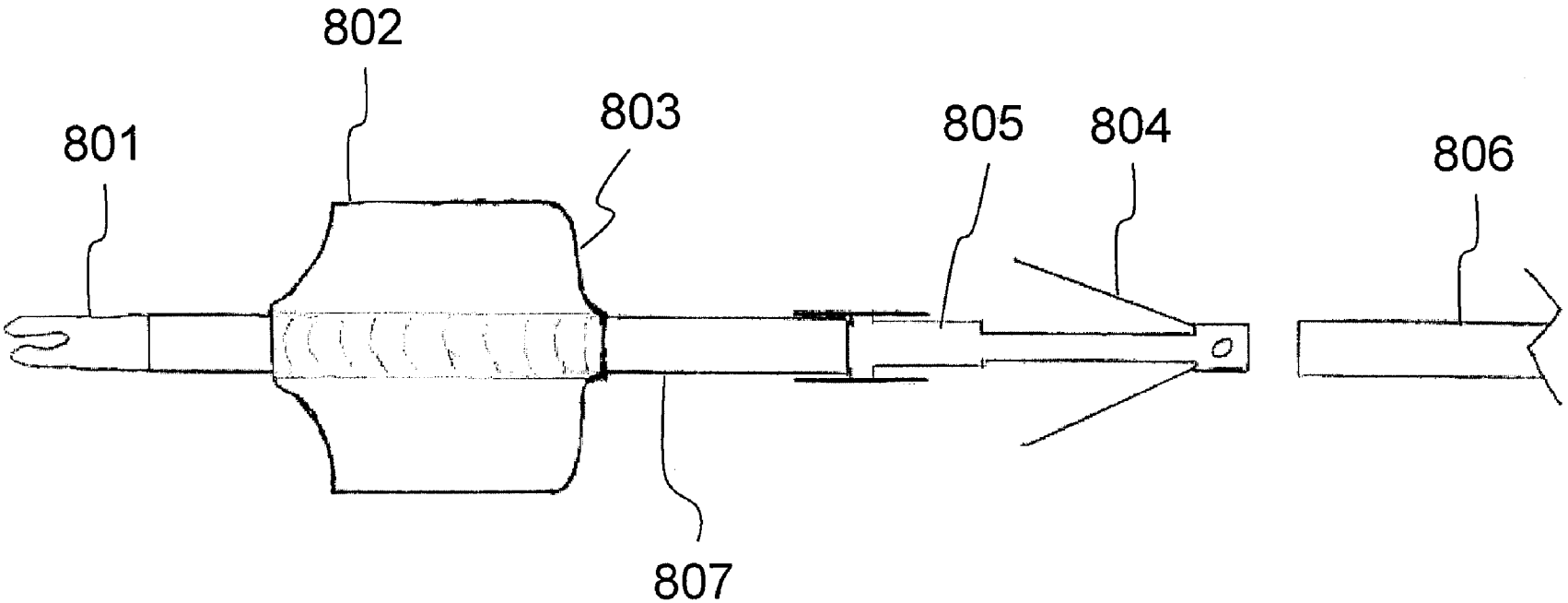
FIG. 8 is an exploded side view of an embodiment of a detachable tracking apparatus.

In one embodiment, the stopping component 3 has one or more integrated wings relatively perpendicular to the rear section 7 for the purpose of, upon target collision, stopping the forward motion of the tracking apparatus at or in the target, thereby detaching the tracking apparatus as the arrow passes through the target. The rear section 7 is preferably made out of a plastic polymer or other durable material that does not interfere with RF signal transmission. In an embodiment shown in FIGS. 1 to 5, the wings are made of any durable material, such as a plastic polymer, carbon, aluminum, or a light-weight alloy. In this embodiment, the wings eliminate the chance to grab or hook onto obstacles by leading with a smooth relatively perpendicular front leading edge similar in appearance to the leading edge of an airplane wing to the body of the airplane. The use of wings with a steeply pitched or straight front leading edge as a stopping component prevents them from getting caught on the hunter's cloths or body parts when in close contact to an arrow nock as the arrow is launched from the bow (such as lips, nose, arm, or hand), bow components (string, sites, arrow rest), or other debris like tree branches and leaves when it is shot in the outdoors. During target collision the wings will physically stop the transmitting nock from penetrating through the target as the arrow continues on out the other side of the target, thus leaving the transmitting behind as the detachable tracking apparatus separates from the arrow shaft. In one embodiment, the size and surface of the wings may be minimized to not effect arrow flight by minimizing air flow contact or by angling to create a rotation similar or the same as the arrow feather or plastic vane angles (such as between 0 and 4 degrees from straight forward). The size and surface of the wings generally depends on the material the wings are made of. For example, an aluminum wing would be thinner than a plastic wing because of the durability of the compound. As depicted in FIG. 8, the arrow vanes 802 would have a steeply pitched or straight front leading edge 803 and act as the stopping component. Alternatively, in another embodiment, the stopping component 3 uses hooks or other similar devices to stop the forward momentum of the tracking apparatus to detach it from the arrow upon target collision.

Figure 5:
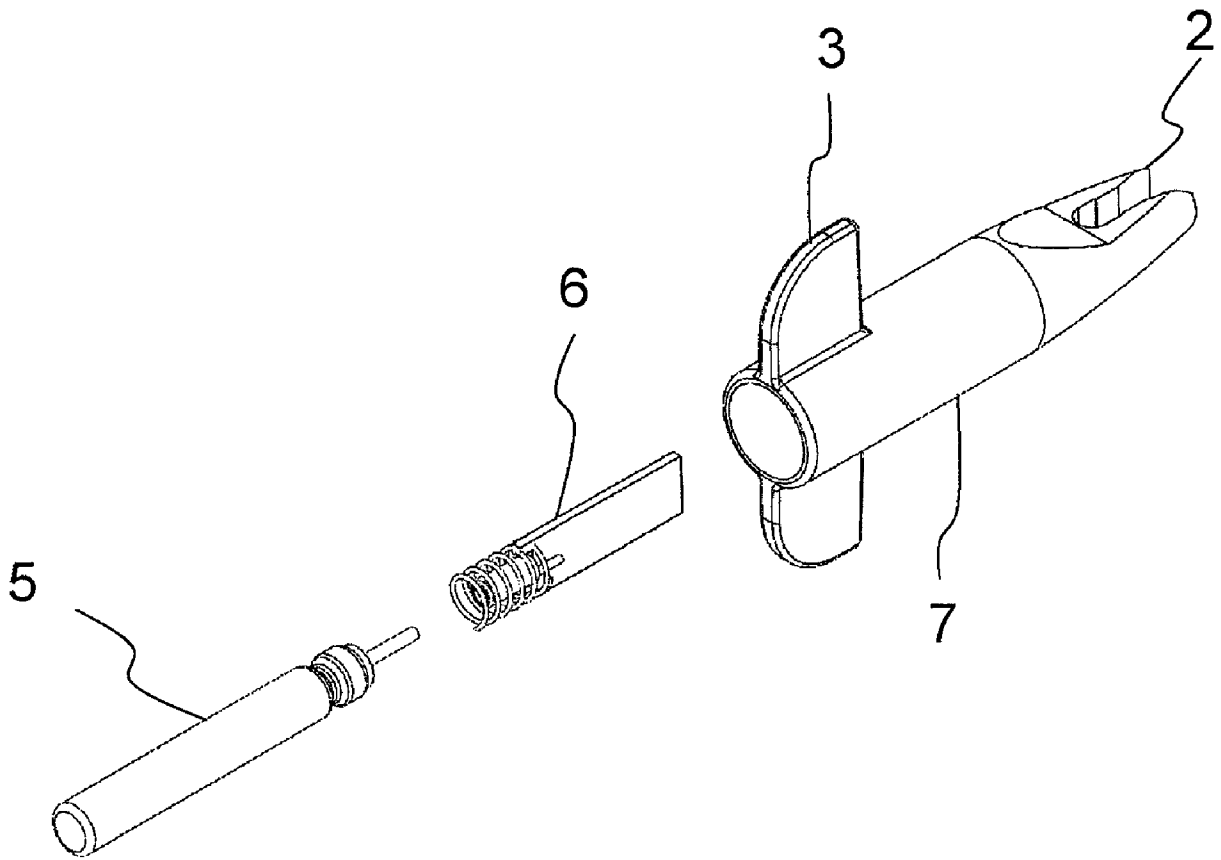
FIG. 5 is an exploded view of an embodiment of a detachable tracking apparatus containing a stopping component, battery, PCB, and arrow nock.

As shown in FIG. 5, in one embodiment, the transmitting device includes a battery 5 that attaches to a PCB 6 which contains the electronics required to generate tracking signals. In one embodiment, the apparatus consists of a radio frequency ("RF") transmitting device that is attached to the tracking apparatus and is able to be located using a hand-held receiver that is carried by an archery hunter that is tuned in to the RF signal generated by the transmitting device. The hunter uses the hand-held receiver to assist in the tracking and recovery of the expired or wounded animal through RF communication between the transmitting device and the hand-held receiver. In one embodiment, the tracking device generates a signal at the 150-155 MHz frequency. In another embodiment, the tracking device generates a signal at a higher frequency, such as 915 MHz.

Figure 2:
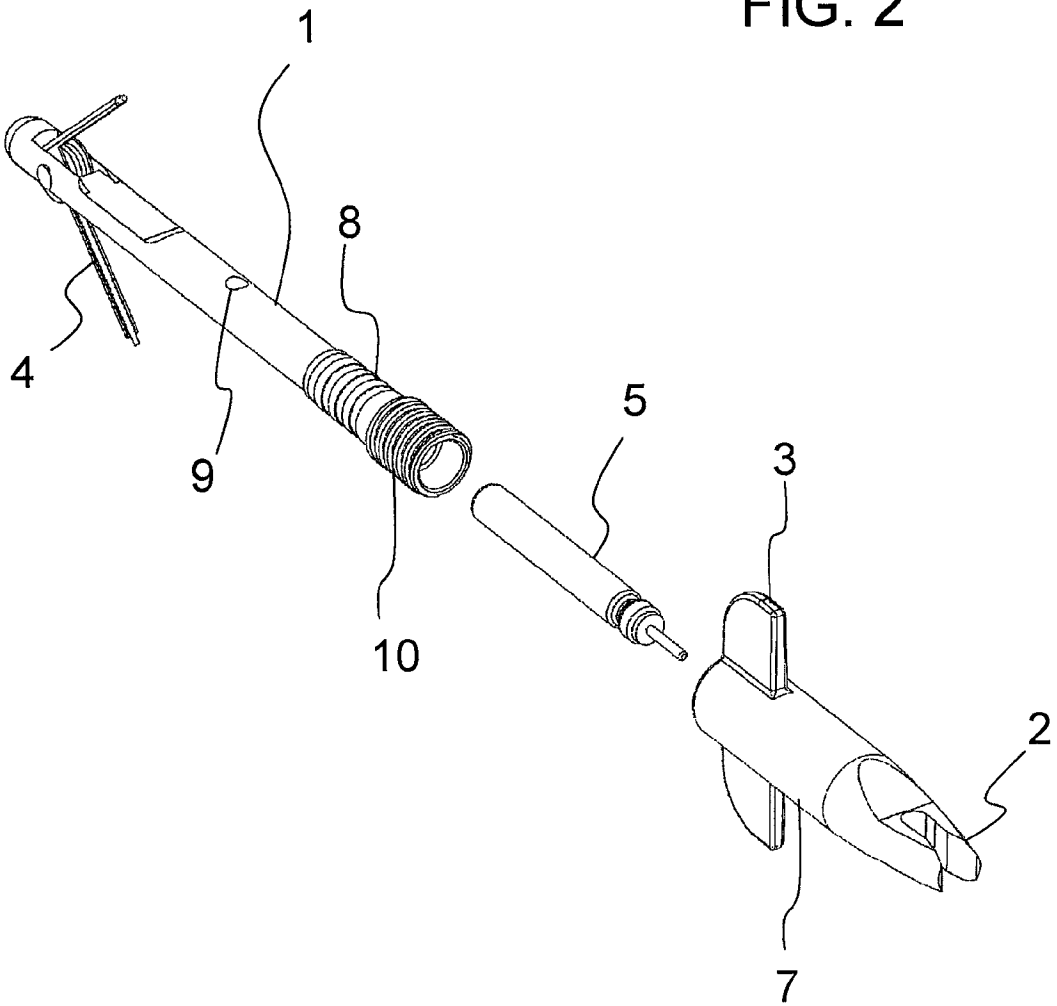
FIG. 2 is an exploded perspective view of an embodiment of a detachable tracking apparatus.
Figure 3:
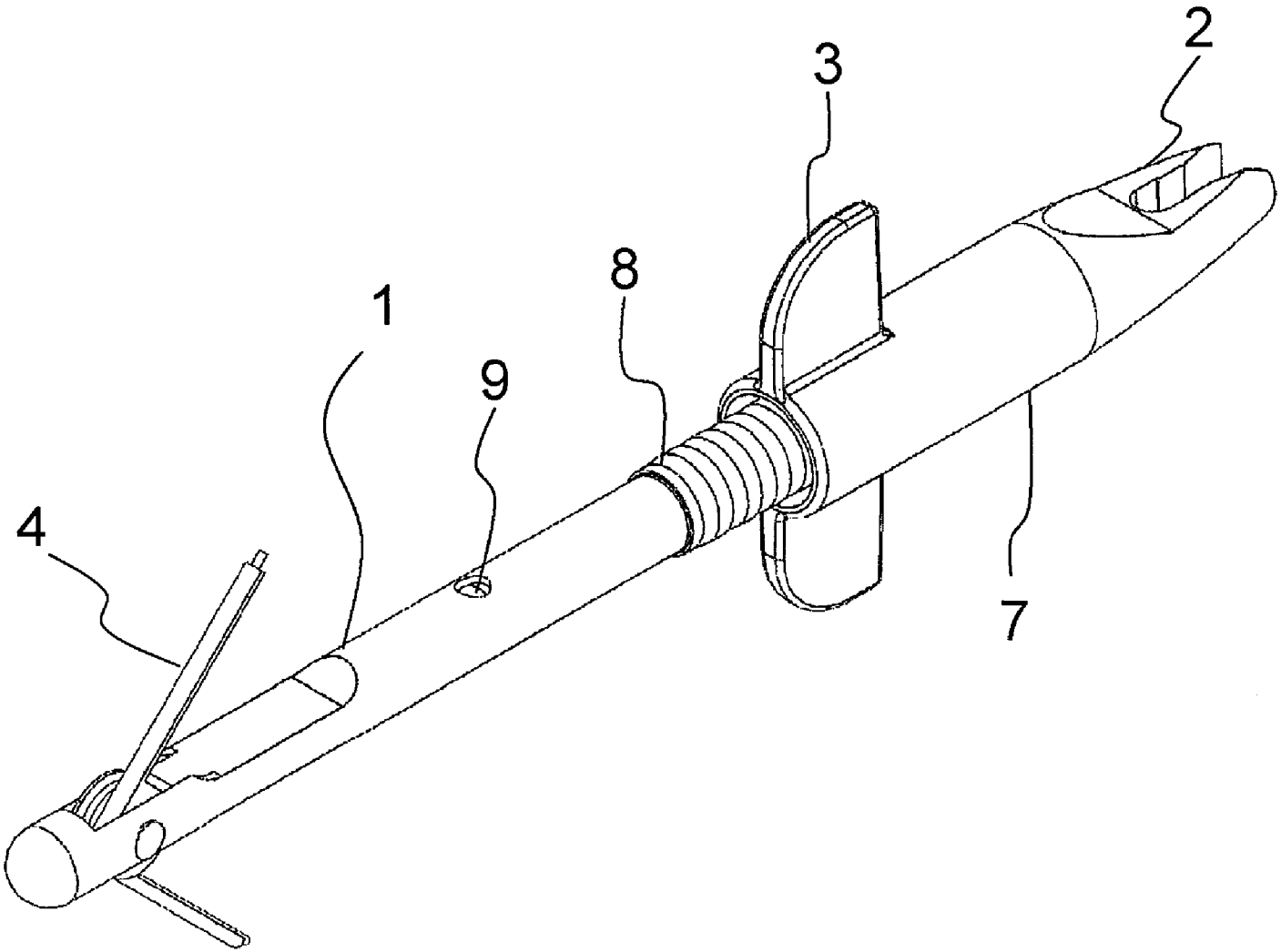
FIG. 3 is a perspective view of an embodiment of a detachable tracking apparatus ready for insertion into an arrow shaft.

In an embodiment, as depicted in FIG. 5, the PCB 6 inserts into a rear section 7 of the apparatus. In one embodiment, the PCB 6 is keyed into a slot in the nock for orientation. In another embodiment, the PCB 6 rests against a solid surface. In yet another embodiment, the pocket surrounding the PCB 6 is filled with a substance for stability and shock suppression, such as silicone adhesive. As depicted in FIGS. 1 and 2, in one embodiment, the battery 5 fits inside the front section 1 upon assembly. The air relief hole 9 may be used for battery insertion and removal. The front section 1 and the rear section 7 are connected in one embodiment by a threaded connection 10. One of skill in the art would appreciate that any suitable type of transmitting device may be used, such as where the transmitting device is light-weight so as not to effect the arrow flight dynamics, can withstand high g-forces and the shock of impact, and can transmit a signal over a distance suitable for tracking wounded game. In an embodiment, the transmitting device transmits global positioning system ("GPS") signals.

The transmitting device preferably integrates a power on/off switch. The switch could be any manual switch as in a sliding switch, an automatic switch (such as a magnetic switch), or an accelerometer or inertia motion sensing switch. In one embodiment, the switch enables the circuit in such a way that the battery must be removed to disarm the device. One of skill in the art would appreciate that any suitable type of switch may be used.

Figure 4:
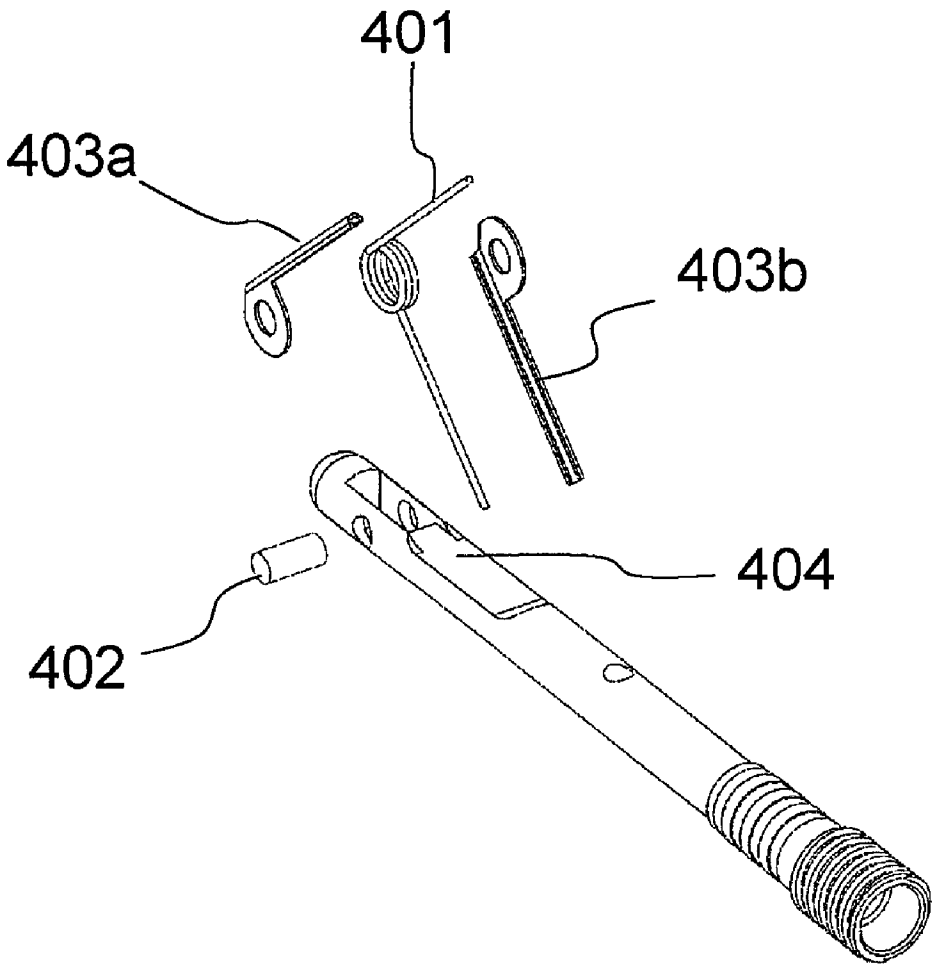
FIG. 4 is an exploded view of an embodiment of a detachable tracking apparatus containing a reverse barbs assembly.

As shown in FIG. 4, in one embodiment, the securing component includes reverse barbs 401 (also known as "spears" or "ribs") angled towards the rear of the arrow that are engaged or released when the tracking apparatus detaches from the arrow upon target collision. In one embodiment, the reverse barbs 401 are attached to or a part of a torsion spring as shown that compresses when the tracking apparatus is pushed into the arrow shaft. The reverse barbs 401 fit into an opening 404 in the front section 1 in an embodiment. Upon impact with the target, the spring swiftly expands as the arrow continues its forward motion through its target and leaves the tracking apparatus behind due to the stopping capacity of the stopping component. When the torsion spring expands (during target collision as the arrow slides off the tracking apparatus) the reverse barbs 401 expand away from the body of the tracking apparatus and hold the detached apparatus firmly in the target by digging into bones, muscles, fat, or skin in order to resist the rebound motion of the detachable tracking apparatus coming to a sudden stop. The torsion spring is strong enough to initiate the separation of the barbs away from the tracking apparatus in order that the reverse barbs hook into the target. The reverse barbs 401 firmly fight any pull or tug on the rear body from outside the animal due to the animal rubbing against obstacles like trees, bushes, ground, and rocks, or the animal instinctively pulling the attached transmitting device out. The tracking apparatus may contain one or more of these torsion springs. Other forms may be used to assist in expansion of the reverse barbs such as compression springs, wave springs, or any other suitable spring or device. In an embodiment, the reverse barbs 401 are hinged by a single pin 402 toward the front of the tracking apparatus whereby the pin also goes through the coil of the torsion spring.

The reverse barbs 401 should be of a sufficient length so as to resist the rebound or deflection motion of the detachable tracking apparatus. In one embodiment, the reverse barbs are 1 inch in length. Other embodiments have shorter or longer reverse barbs, depending on the material the barbs are made of and the number of barbs. For example, in one embodiment, a detachable tracking apparatus with more than two reverse barbs has reverse barbs of ¼ inch. Another embodiment has one reverse barb made out of a strong metal alloy of a 1 and ½ inches. One of skill in the art would appreciate that a modification to the length and number of reverse barbs is suitable as long as the barbs resist the rebound motion of the detachable tracking apparatus coming to a sudden stop.

As shown in FIG. 4, in one embodiment, the securing component includes reinforcing arms 403*a* and 403*b* that fit over or clip onto the torsion spring reverse barbs 401. In this embodiment, the torsion spring helps in the expansion of the reinforcing arms. The reverse barbs 401 and reinforcing arms 403*a* and 403*b* can be made of a light-weight, durable material, such as stainless steel, music steel, aluminum alloy, or a plastic polymer, among others. The reinforcing arms may be made out of a different material than the reverse barbs 401.

In an alternate embodiment (not depicted), the securing component is comprised of reverse barbs hingedly connected to the front section that engage into the target animal upon a rebound motion of the tracking apparatus rather than by spring force upon detachment of the tracking apparatus. In such an embodiment, the reverse barbs are enclosed within the tracking apparatus such that the end of the barbs are in a closed position while inside the shaft of the arrow but can engage with the target because of either the force of the stopping momentum or from the ends of the barbs catching on the target during the rebound or deflection motion.

In one embodiment of the disclosed apparatus and system, the hand-held receiver is paired or synchronized to the specific transmitter signal of the transmitting device. The hand-held receiver will assist the hunter by guiding the hunter in the direction or to the location of the transmitting nock. The hand-held receiver may incorporate visual indicators of the direction or location of the transmitting device as well as other indicators such as sounds or vibration to name only a couple. The hand-held receiver may also incorporate indicators such as if the transmitting nock is in motion or is still, and for how long has it been still, and may incorporate features such as a clock, a stopwatch, a barometer, a thermometer, an altimeter, and other features.

Figure 6:
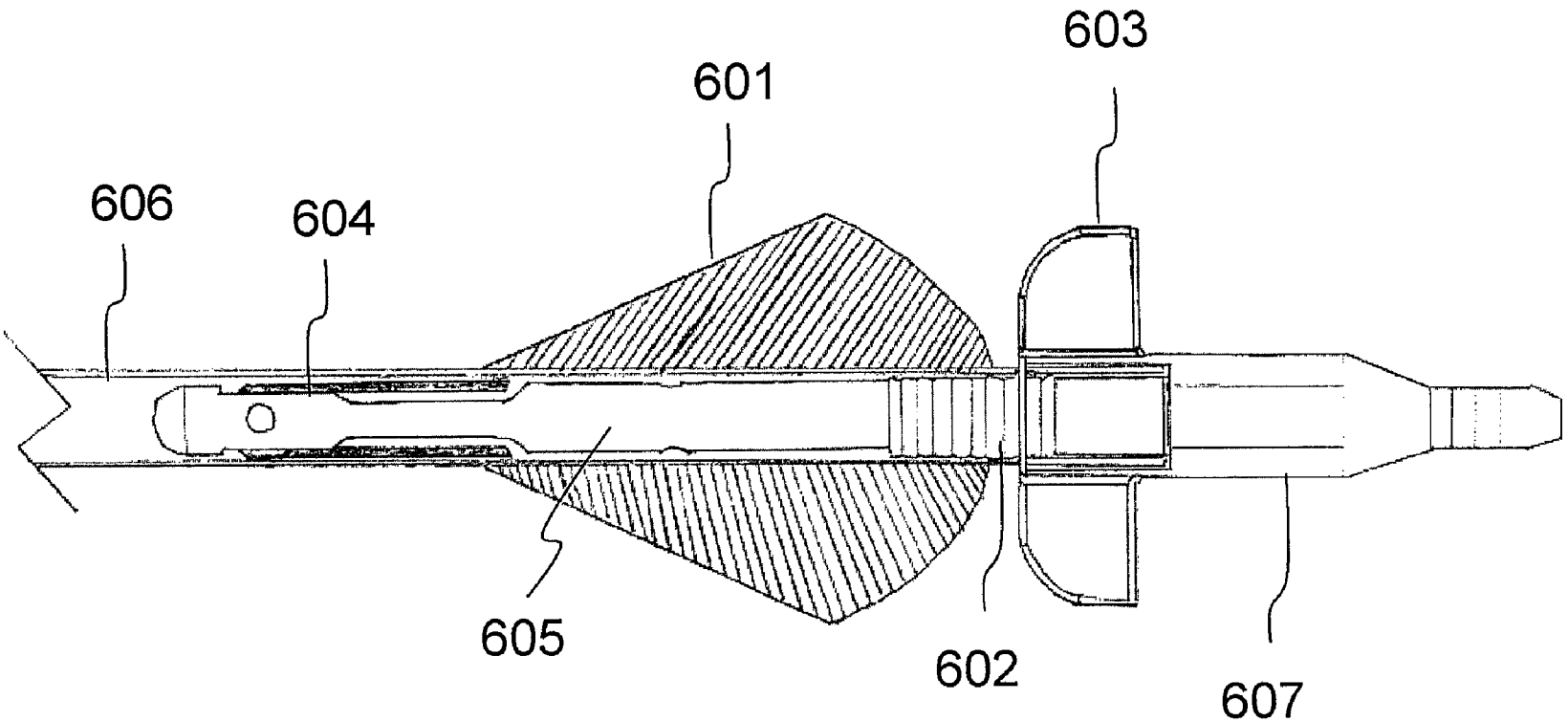
FIG. 6 is a side view of a portion of an assembled embodiment of a detachable tracking apparatus inserted into an arrow shaft.

FIG. 6 depicts an embodiment of a tracking apparatus inserted into an arrow shaft. In this embodiment, the front portion 605 of the tracking apparatus, which covers the battery for the transmitting device and includes reverse barbs 604, is inserted into the arrow shaft 606. The reverse barbs 604 fold into the arrow shaft 606 upon insertion. In one embodiment, arrow vanes 601 are glued or bonded to the outside of the arrow shaft in front of the stopping component 603. The rear section of the tracking apparatus 607, which includes the stopping component 603, connects to the front section 605 by a threaded connection or bonding. The joined tracking apparatus sections are secured to the arrow shaft 606 through an interference fit at the ridged portion 602.

Figure 7:
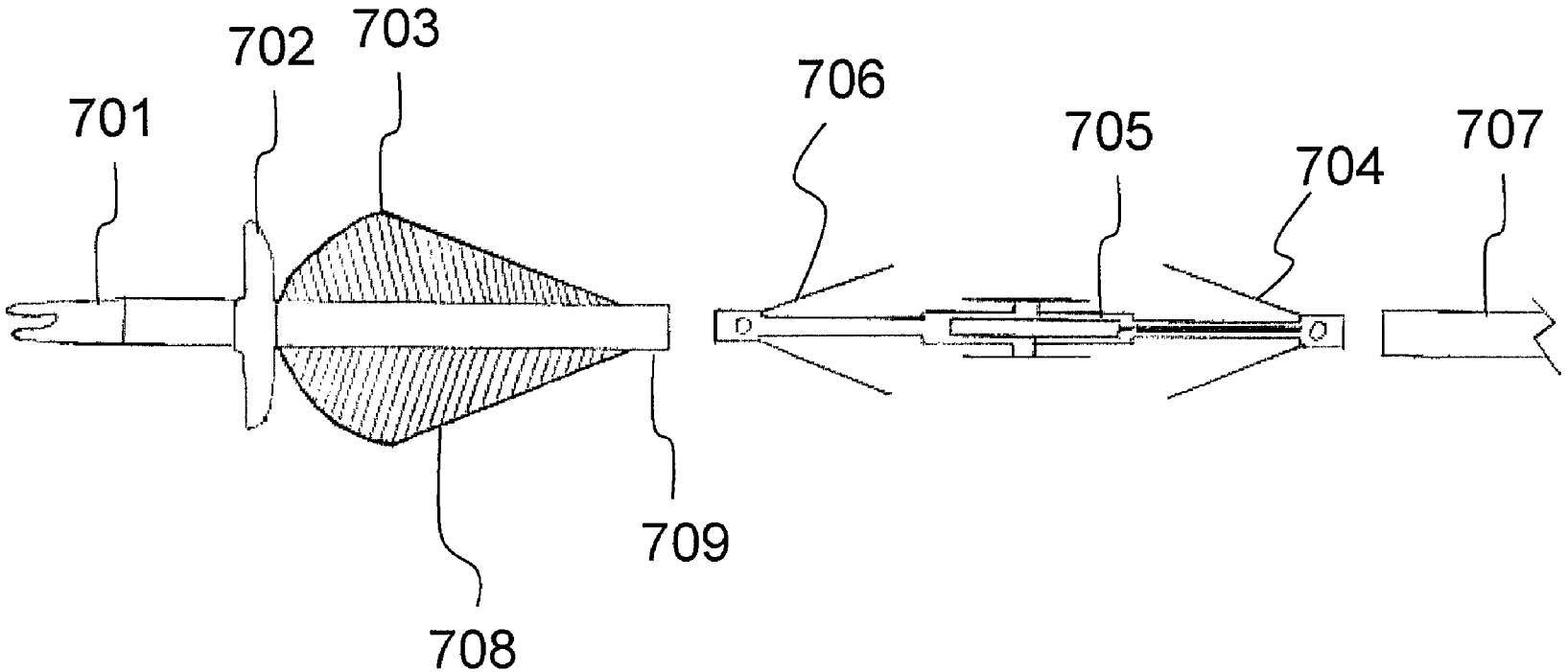
FIG. 7 is an exploded side view of an embodiment of a detachable tracking apparatus.

As depicted in FIG. 7, in one embodiment, the tracking apparatus is inserted into a two-piece arrow allowing the hunter to use a preferred arrow nock 701 and arrow feathers or vanes 703. In this embodiment, the tracking apparatus housing 705 containing the transmitting device, which again may include a battery and PCB containing the transmitting electronics, and reverse barbs 704 are inserted inside the front arrow section 707 and the rear arrow section 709. The apparatus contains forward barbs 706 that angle towards the front of the arrow when released that act as an anchor component for stopping the forward motion of the tracking apparatus. In this embodiment, the tracking apparatus containing the transmitting device and forward barbs 706 and reverse barbs 704 slides in and fits snugly into the hollow rear arrow tube section 709 and front arrow tube section 707. In one embodiment, the rear arrow section has a winged stopping component 702 attached over the arrow shaft by bonding, such as glue or pressure, behind the arrow vanes 703 and 708. Upon target collision, the winged stopping component 702 stops the rear arrow section upon target collision allowing the front arrow section to continue into and thru the target. In an embodiment, the front and rear arrow sections are connected together through the interference fit between the housing 705 and the front and rear arrow sections and held together by pressure between the device and the arrow inside wall. The interference fit should be tight enough to keep the arrow pieces firmly together while drawing and releasing the arrow, yet loose enough to break apart when the wing stopping component 702 stops the rear arrow section upon target collision. Upon target collision, the forward angled barbs 706 engage and stop the forward motion of the tracking apparatus and the reverse barbs 704 engage to prevent rebound or deflection motion, keeping the tracking apparatus firmly in place inside the target animal.

Figure 9:
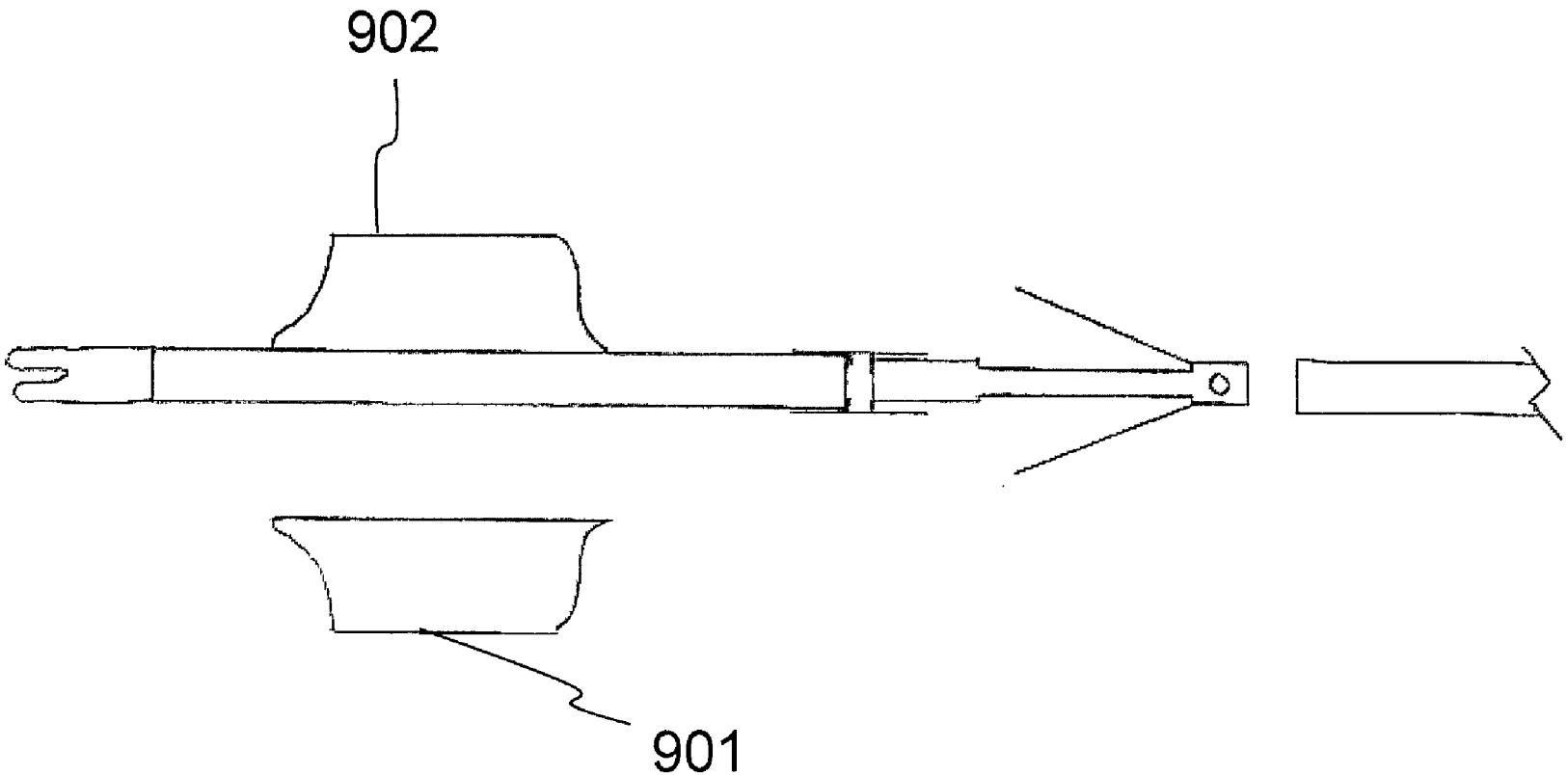
FIG. 9 is an exploded side view of an embodiment of a detachable tracking apparatus.
Figure 10:
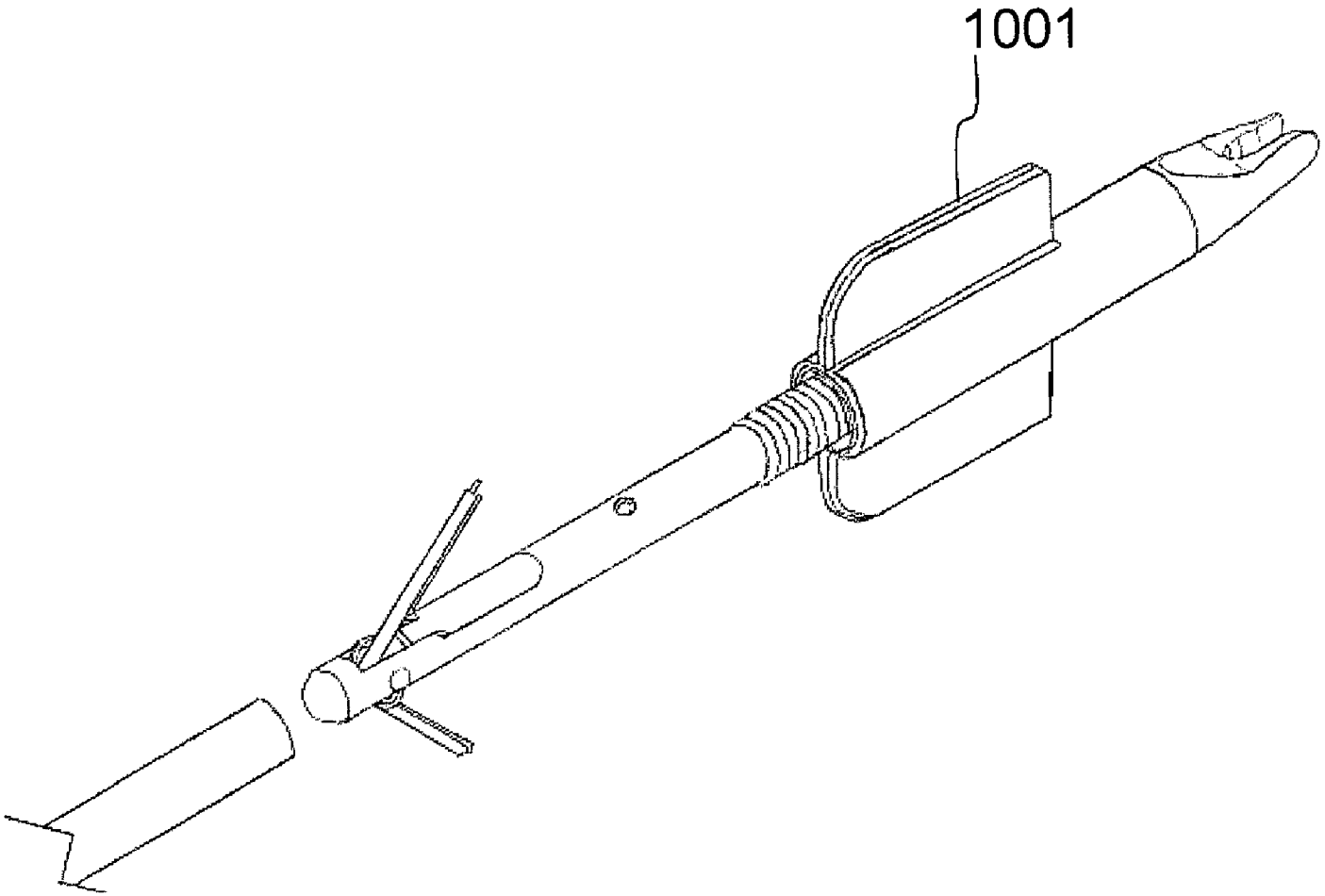
FIG. 10 is an exploded perspective view of an embodiment of a detachable tracking apparatus.

As depicted in FIG. 8, in another embodiment, the tracking apparatus is also mounted in a detachable rear segment of a two-piece arrow but secured to the rear arrow section 807. In this embodiment, the tracking apparatus housing 805 containing the tracking device and reverse barbs 804 is inserted into the front arrow section 806 and the rear arrow section 807. When the front arrow section 806 is connected to the rear arrow section 807, the reverse barbs are folded inside of the arrow shaft. As shown, the reverse barbs 804 angle back toward the rear end of the arrow upon release. The flexible or hinged reverse barbs 804 are mounted in the connection point between the two arrow pieces folded into the smaller diameter housing 805 which is connected to the rear arrow section 807. The apparatus housing 805 slides into the front arrow section 806. The housing 805 is attached to the rear arrow section 807 by a threaded connection or bonding or soldering. In one embodiment, the arrow vanes 802 have a steeply pitched or straight front leading edge 803 and act as the stopping component. In one embodiment, the arrow vanes are part of a one piece component that slides over and bonds to the arrow shaft as depicted in FIG. 8. In an alternative embodiment, as depicted in FIG. 9, the arrow vanes 901 and 902 are affixed to the arrow shaft through bonding, such as glue or pressure. FIG. 10 depicts another embodiment where the arrow vanes are replaced by thicker stopping wings 1001.

The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto.

What is claimed is:

1. A tracking apparatus for detaching and securing a transmitting device carried by an arrow having a front end and rear end onto a target, said tracking apparatus comprising:

a transmitting device for transmitting a signal to a receiving device;

a stopping component for detaching the tracking apparatus from the arrow after the arrow collides with the target; and a securing component for securing the tracking apparatus to the target, said securing component including barbs angled towards the rear end of the arrow for stopping rebound motion of the tracking apparatus after the arrow collides with the target, wherein the securing component includes a torsion spring.

2. The tracking apparatus of claim 1, wherein the barbs are reinforced with reinforcing arms.

3. The tracking apparatus of claim 1, wherein the barbs are at least one inch in length.

4. The tracking apparatus of claim 1, wherein the barbs are at least one half inch in length.

5. The tracking apparatus of claim 1, wherein the barbs are at least one and one half inches in length.

6. The tracking apparatus of claim 1, wherein the securing component includes at least two of said barbs.

7. The tracking apparatus of claim 1, wherein the securing component includes at least four of said barbs.

8. The tracking apparatus of claim 1, wherein the stopping component includes one or more wings with a front edge facing the front end of the arrow that is relatively perpendicular to the axis of the arrow.

9. The tracking apparatus of claim 1, wherein the stopping component includes arrow vanes with a front edge that is relatively perpendicular to the axis of the arrow.

10. A detachable nock for detaching and securing a transmitting device carried by an arrow having a front end and rear end onto a target, said detachable nock comprising:

an opening for receiving a bowstring situated at the rear of the detachable nock;

a transmitting device for transmitting a signal to a receiving device;

a stopping component for detaching the detachable nock from the arrow after the arrow collides with the target, wherein the stopping component includes one or more wings with a front edge facing the front end of the arrow that is relatively perpendicular to the axis of the arrow; and a securing component for securing the detachable nock to the target, said securing component including barbs angled towards the rear end of the arrow for stopping rebound motion of the detachable nock after the arrow collides with the target, wherein the barbs are reinforced with reinforcing arms.

11. The detachable nock of claim 10, wherein the securing component includes a torsion spring.

12. The detachable nock of claim 10, wherein the barbs are at least one inch in length.

13. A tracking apparatus for detaching and securing a transmitting device carried by an arrow having a front end and rear end onto a target, said tracking apparatus comprising:

a transmitting device for transmitting a signal to a receiving device;

a stopping component for detaching the tracking apparatus from the arrow after the arrow collides with the target;

an anchor component for stopping forward motion of the tracking apparatus after the arrow collides with the target, said anchor component including forward barbs angled towards the front end of the arrow; and a securing component for securing the tracking apparatus to the target, said securing component including reverse barbs angled towards the rear end of the arrow for stopping rebound motion of the tracking apparatus after the arrow collides with the target.

14. The tracking apparatus of claim 13, wherein the forward barbs are reinforced with reinforcing arms.

15. The tracking apparatus of claim 13, wherein the reverse barbs are reinforced with reinforcing arms.

16. The tracking apparatus of claim 13, wherein the anchor component includes a torsion spring.

17. The tracking apparatus of claim 13, wherein the securing component includes a torsion spring.

18. The tracking apparatus of claim 13, wherein the stopping component includes one or more wings with a front edge facing the front end of the arrow that is relatively perpendicular to the axis of the arrow.

* * * * *